United States Patent [19]

Wallding et al.

[11] 4,027,426

[45] June 7, 1977

[54] PRE-LABELLED COATED CONTAINER

[75] Inventors: Wayne A. Wallding, Horseheads; Roy S. Arrandale, Elmira, both of N.Y.

[73] Assignee: Dart Industries Inc., Los Angeles, Calif.

[22] Filed: Jan. 15, 1975

[21] Appl. No.: 541,903

Related U.S. Application Data

[62] Division of Ser. No. 466,333, May 2, 1974, abandoned.

[52] U.S. Cl. ..... 40/310

[51] Int. Cl.² ..... G09F 3/10

[58] Field of Search ..... 40/2 R, 310, 306, 312, 40/125 A, 135; 428/511, 441; 156/327, 307

[56] References Cited

UNITED STATES PATENTS

| | | | |
|---|---|---|---|
| 2,825,159 | 3/1958 | Schor | 40/306 |
| 3,110,554 | 11/1963 | Yazumi | 40/306 X |
| 3,153,868 | 10/1964 | Jones | 40/2 R |
| 3,334,003 | 8/1967 | Edwards | 156/235 |
| 3,616,005 | 10/1971 | Wetstone | 156/183 |
| 3,638,340 | 2/1972 | Gottschalk | 40/306 |
| 3,733,002 | 5/1973 | Fujio | 40/310 |
| 3,791,915 | 2/1974 | Goehring | 40/2 X |
| 3,839,119 | 10/1974 | Solomon | 156/234 |
| 3,856,498 | 12/1974 | Campagna | 40/2 X |
| 3,889,030 | 6/1975 | Arrandale | 427/314 |
| 3,898,357 | 8/1975 | Miller | 428/42 |

*Primary Examiner*—Russell R. Kinsey
*Assistant Examiner*—Wenceslao J. Contreras
*Attorney, Agent, or Firm*—Kenneth J. Hovet

[57] ABSTRACT

Containers are provided with a label and subsequently coated to seal and protect the label while enhancing the appearance and durability of the container. The coating also gives the label an appearance of depth and greatly enhances its appeal and attractiveness.

5 Claims, No Drawings

PRE-LABELLED COATED CONTAINER

This is a division of application Ser. No. 466,333, filed May 2, 1974, now abandoned.

BACKGROUND OF THE INVENTION

1. Field of the Invention

This invention relates to labelling containers and, more particularly, to a container having a label beneath a coating thereover.

2. Description of the Prior Art

The application of labels to containers generally occurs where the container is filled so as to conform to the contents without fear of mix-up. This procedure is costly and requires substantial capital investment by a bottler, shipper, distributor, or the like. Further, the protection of labels once they are attached to a container is a serious problem. Containers are frequently subjected to rough treatment on high volume mass production lines, during shipment, and during subsequent handling for display and sale.

Various techniques have been devised to overcome the abrasion problem such as the application of lubricant coatings or the use of extra strong labels such as metallic laminates or fused plastic bands. Some manufacturers have sought to overcome the problem by applying decorative or printed matter directly upon the surface of the container. Of course, this requires complicated printing apparatus and the use of ceramic or resinous inks which will adhere tenaciously to the container surfaces without fear of being rubbed or chipped off. It has been suggested to heat shrink a thermoplastic material over a label or have the heat-shrinkable material printed with the desired label information. Quite often this results in distortion of the printed or decorative material on the label and, requires the use of special inks that will adhere to the shrinkable material. A further disadvantage is that the heat-shrinking sleeve is by necessity relatively thick such that its covering of a label or printed material on a container results in visual obstruction or distortion. Still further, a problem with heat-shrinking a thermoplastic sleeve about a container is that a different sleeve will be required for each of the various sized containers. The problems and disadvantages inherent with this are obvious.

SUMMARY OF THE INVENTION

In accordance with the present invention a prelabelled container is provided having a protective coating over both the label and container. The label and bottle are covered with a fluid thermoplastic material which function to seal and protect the label from abrasion while providing a container that is highly resistant to breakage and shattering. Additionally, the attractiveness and consumer appeal of the label beneath the transparent or translucent coating is greatly enhanced.

Various types of coatings may be provided over the label to provide enumerable decorative effects while remaining transparent so that the label may be viewed through the coating. The coating surface may be pebbled or smooth, burnished, or impressed with a design. A highly advantageous feature of the invention is that the coating is applied in a fluid or powdered state such that all surfaces of the label and container, however irregular, will be substantially uniformly covered.

Having a coating over the label prevents newly manufactured bottles, jars, tumblers, cargons or other type of containers from becoming scratched or marred when rubbed against one another during filling, handling or subsequent shipment. The appearance of the exterior surfaces of bottles sold directly to consumers is especially important since in such a case appearance is important to create a consumer appeal. Because the label is beneath a coating, it is given an appearance of depth which will be attractive to a consumer.

Accordingly, a primary object of the invention is to provide an improved pre-labelled container not subject to the abrasion and breakage common with other labelled containers and yet is attractive in appearance.

Another object of the invention is to provide a method of pre-labelling a container comprising the application of a label to a container with the subsequent application of a fluid thermoplastic material over both the label and container surfaces to effect a continuous protective coating thereof.

DESCRIPTION OF PREFERRED EMBODIMENTS

Co-pending patent application Ser. Nos. 232,455, 232,412 and 232,589, all filed on Mar. 7, 1972, relate to the coating of containers with a fluid thermoplastic material. These applications together with patent application, Ser. No. 282,824 filed Aug. 22, 1972, also relating to coated containers, are herein incorporated by reference. Of particular interest is that the above applications show the coating of a container with a fluid plastic material directly upon the container. With the present invention, these techniques have now been adapted to not only coating a container, but coating a container having a label thereon so that the coating effectively seals the label to the container.

In accordance with a typical embodiment of the present invention, a glass bottle is provided with a thin paper label and covered with a continuous coating of a polyolefin. Initially, a clean bottle is preferably preheated to a temperature range of about 100°–250° F and coated with a first undercoating. Alternatively, a bottle may be cleaned with a hot water wash and while still hot (at least above 100° F), the undercoating is applied.

It is to be understood that an undercoating is optional with the process of the present invention. Its use is determined by the type of thermoplastic material to be utilized as an outer coating, the type of label being coated, and the type of container being labelled. The undercoating may be applied to the container by rollers, dipping or spray devices. For the purposes of the present invention the undercoating should be compatible with the label, the container, and the outercoating. If a label adhesive is used, it should also be compatible with the undercoating.

A preferred undercoating is a polymer of ethylenically unsaturated carboxylic acid. An example of such would be an aqueous solution of polyacrylic acid having a molecular weight of about 150,000 to 300,000 and a concentration of 0.5–25 percent by weight polyacrylic acid with the balance water. Typically, the undercoating is less than 0.001 of an inch thick.

Where an aqueous polyacrylic acid solution is utlized it is partially dryed to remove excess water. Thereafter a sheet-like label is placed upon the container in whatever position or location is desired. The label may be mechanically held in position on the container during the process before application of the outercoating by plastic band means, fine thread, dissolvable tape means, electrostatic attraction or by various known decal transfer techniques. Of course, the label may be coated with an adhesive or the like. However, it is to be understood that if an adhesive material is used, it must be resistant to the effects of the preheat temperatures and it must be compatible with any undercoating that may be used. If an undercoating is utilized, it is within the purview of the present invention to apply the label to the undercoating while it is in a tacky condition thereby obviating the necessity of a separate adhesive on the back of the label.

When known high speed labelling machines are used, it is preferable to coat at least a portion of the inner surfaces of the label with an adhesive. In such a case, the adhesive material must resist the effects of temperatures up to 600° F and be compatible with the coatings, container material, and label material. As an example, a concentrated aqueous solution of polyacrylic acid may be used with a 10 to 50 weight percent concentration of polyacrylic acid. This produces a viscous label adhesive composition which is simply a more concentrated version of the undercoating solution. The increased viscosity facilitates the application of the label to the bottle and minimizes inadvertent slippage and displacement.

There are many labelling systems available and substantially any device or technique known in the art for applying a label with or without an adhesive material on the back thereof would be suitable for the purposes of the present invention.

Preferred labels for use with the present invention comprise thin paper or heat resistant plastic or cloth labels with or without printed material or decorative material thereon. A foil label or a laminated foil-paper material commonly found in the industry may also be used but suffer a disadvantage in being heat conductive and prone to becoming discolored during subsequent process steps. Certain paper or similar insulating types of material are preferred because such materials will not melt, char or discolor noticeably. Also such labels obviate hot spots in the subsequent hot plastic coating step which may cause a concomitant uneveness in the outer plastic coating.

No special treatment is needed for the label and, in fact, the less expensive mass-printed paper labels have been found to be especially suitable. When such paper labels are used, the polyolefin overcoating imparts a gloss not inherent when the paper labels are used by themselves. The label is preferably sheet-like and may be substantially any configuration or design. The label shape, design, composition and configuration are simply dictated by commercial needs and consumer appeal. Similarly, more than one label could be used and/or the label could conceivably cover large portions of the container. With regard to large labels, the only criteria is that there should be some exterior surfaces of the container exposed against which an outercoating could be secured. Of course, the coating should also be harmonious with the labelling material.

After the label has been positioned on the container, the container is passed through a preheat oven or the like to heat the container to a temperature suitable for the subsequent application of the outer thermoplastic coating. In the case of the application of a fluid plastic material comprising a homopolymer of a polyolefin, the container should be preheated to a temperature of about 350°–600° F. This may be accomplished by passing the container through an oven for about 5–30 minutes.

After preheating, the container may be coated by dipping it in a fluidized bed of polyolefin powder or the polyolefin may be electrostatically sprayed upon the pre-labelled container or the container may be dipped, rolled or brushed with a plastic solution. It has been found desirable to confine the outer coating thickness to a range between about 0.004 to 0.035 inch. Such a coating may be obtained by electrostatic spraying of fluidized bed dipping of the container with a powdered polyethylene material having a melt index in the range of about 5 to 100 and a particle size of from 20 mesh to 300 mesh (Tyler Standard). If an undercoating has not been applied to the container, then the polyolefin should preferably have some ionic compounds mixed therein such as polyacrylic acid and/or vinyl acetate compounds to facilitate bonding to the container. In the instance where the container has been primed with the aforementioned aqueous polyacrylic acid solution, a polyolefin homopolymer such as polyethylene may be utilized alone.

The coated container may be subsequently cured and/or tempered by reheating and quenching to obtain a clear transparent coating. Similarly, the coating may have a slight ting or contain a reflective filler to enhance the appearance of the label and container. The curing step is to effect a final fusing or sintering of the coating upon the container. The tempering and subsequent steps have been found to enhance the clarity of the plastic coating. However, a pebbled surface may be attained by adjusting the melt index of the plastic coating material, particle size and/or the coating temperature.

It will be apparent to those skilled in the art that many other variations may be made in the coating materials, the label materials, and the label design together with the technique of application without departing from the spirit and scope of the claimed invention.

What is claimed is:

1. A pre-labelled container having glass sidewalls substantially covered with an undercoating of a polymer of ethylenically unsaturated carboxylic acid;

a label of heat insulative material having a lesser areal extent than said undercoating, said label being bonded to said undercoating with an adhesive consisting of a polymer of ethylenically unsaturated carboxylic acid; and, a continuous plastic outercoating over said label and said polymer film, said outercoating being permanently bonded to said undercoating.

2. The container of claim 1 wherein said outercoating is 0.006–0.012 inches thick and comprises a polyolefin.

3. The container of claim 1 wherein said undercoating and said adhesive comprise polyacrylic acid.

4. The container of claim 1 wherein said label comprises paper.

5. The container of claim 3 wherein a major constituent of said outer coating comprises polyethylene.

* * * * *